United States Patent [19]

Van Allen et al.

[11] 4,014,202

[45] Mar. 29, 1977

[54] CRIMPING APPARATUS

[75] Inventors: Richard Van Allen, Cary; Raymond M. Wylie, Wildwood, both of Ill.

[73] Assignee: Anchor Coupling Co. Inc., Libertyville, Ill.

[22] Filed: June 4, 1975

[21] Appl. No.: 583,636

[52] U.S. Cl. ..... 72/402; 29/237; 72/35; 72/452; 72/453.01; 72/461

[51] Int. Cl.[2] ..... B21J 9/06

[58] Field of Search ..... 72/402, 461, 32, 35, 72/36, 453.01, 452; 29/237

[56] References Cited

UNITED STATES PATENTS

| | | | |
|---|---|---|---|
| 2,999,405 | 9/1961 | Ewart | 72/402 |
| 3,154,978 | 11/1974 | Baker | 72/402 |
| 3,335,594 | 8/1967 | Peterman | 72/402 |
| 3,396,570 | 8/1968 | McCardell | 72/402 |
| 3,417,598 | 12/1968 | Valente | 72/402 |
| 3,461,710 | 8/1969 | Luedi | 72/402 |
| 3,762,209 | 10/1973 | Herndon | 29/237 |
| 3,805,580 | 4/1974 | Lieker | 29/237 |
| 3,851,514 | 12/1974 | Chen | 29/237 |
| 3,879,834 | 4/1975 | Johnson | 29/237 |

FOREIGN PATENTS OR APPLICATIONS

| | | | |
|---|---|---|---|
| 732,810 | 4/1966 | Canada | 29/237 |

*Primary Examiner*—C.W. Lanham
*Assistant Examiner*—Gene P. Crosby
*Attorney, Agent, or Firm*—Johnston, Keil, Thompson & Shurtleff

[57] ABSTRACT

A compact apparatus for crimping a fitting onto an elongated member is provided which has a cylindrical housing, a tubular piston in the housing providing a central passageway to receive the elongated member and a fitting, a plurality of crimping dies moving radially together and apart which are actuated by the tubular piston, fluid means for moving the tubular piston longitudinally in a forward direction and springs for retracting it, and mounting means for the cylindrical housing. The apparatus contains an improved housing and piston structure, means for positioning the elongated member and fitting between the crimping dies, and means to automatically stop the longitudinal movement of the piston at a predetermined position.

17 Claims, 10 Drawing Figures

CRIMPING APPARATUS

BACKGROUND

Various types of apparatus for crimping fittings onto an elongated member such as a hose end have heretofore been proposed. Reference is made to U.S. Pat. Nos. 3,335,594 and 3,805,580, as illustrating the state of the art.

One of the problems which confronts the art is the provision of an apparatus which is versatile enough to accommodate linear fittings as well as elbow fittings or non-linear fittings.

OBJECTS

One of the objects of the present invention is to provide a new and improved, relatively simple and compact crimping apparatus for crimping a fitting onto an elongated member such as a hose which will accommodate either linear or non-liner (e.g., elbow) fittings.

Another object of the invention is to provide a new and improved apparatus of the type described in which a tubular piston operates within confines of a cylindrical housing with the housing and the piston having offset complemental inner and outer walls, respectively, so that the entire apparatus is very compact.

A further object of the invention is to provide an apparatus of the type described containing a cylindrical housing and a tubular piston operative within said housing to actuate a plurality of crimping dies and with a central passageway large enough to receive an elongated member and either linear or non-linear fittings.

Still another object of the invention is to provide an apparatus of the type described in which there is a positioning member to position the elongated member and fitting properly between the crimping dies.

Another objects of the invention is to provide an apparatus of the type described which contains means for automatically stopping the longitudinal movement of the piston at a predetermined position.

Other objects and advantages of the invention will appear from the following description in conjunction with the accompanying drawings.

THE DRAWINGS

FIG. 1 is a front perspective view illustrating the apparatus provided in accordance with the invention;

FIG. 1*a* is a perspective view of one of the crimping dies used in the crimping apparatus shown in FIG. 1;

FIG. 2 is a rear perspective view of the crimping apparatus shown in FIG. 1;

BRIEF SUMMARY OF THE INVENTION

A compact apparatus for crimping a fitting onto an elongated member is provided which has a cylindrical housing, a tubular piston in said housing providing a central passageway to receive said elongated member and a fitting, a plurality of crimping dies moving radially together and apart which are actuated by said tubular piston, means for moving said tubular piston longitudinally in a forward direction and for retracting it, and mounting means for the cylindrical housing, the apparatus containing several features including: an inner wall of said cylindrical housing being offset inwardly at an intermediate point between its forward and rear ends, an outer wall of said piston offset outwardly complementally to the offset inner wall of said housing, and means for introducing and withdrawing a fluid under pressure through the outer wall of said cylindrical housing and the inner wall of said cylindrical housing in the area where said inner wall is offset inwardly so that said fluid will impinge on the offset portion of said outer wall of said piston and cause said piston to move foward longitudinally; a stop plate connected to the rear end of said cylindrical housing extending in a plane which intersects the path of said elongated member and fitting and which functions to position the latter between the crimping dies; and means to automatically stop the longitudinal movement of said piston at a predetermined position.

DETAILED DESCRIPTION OF THE INVENTION

Figure 1:
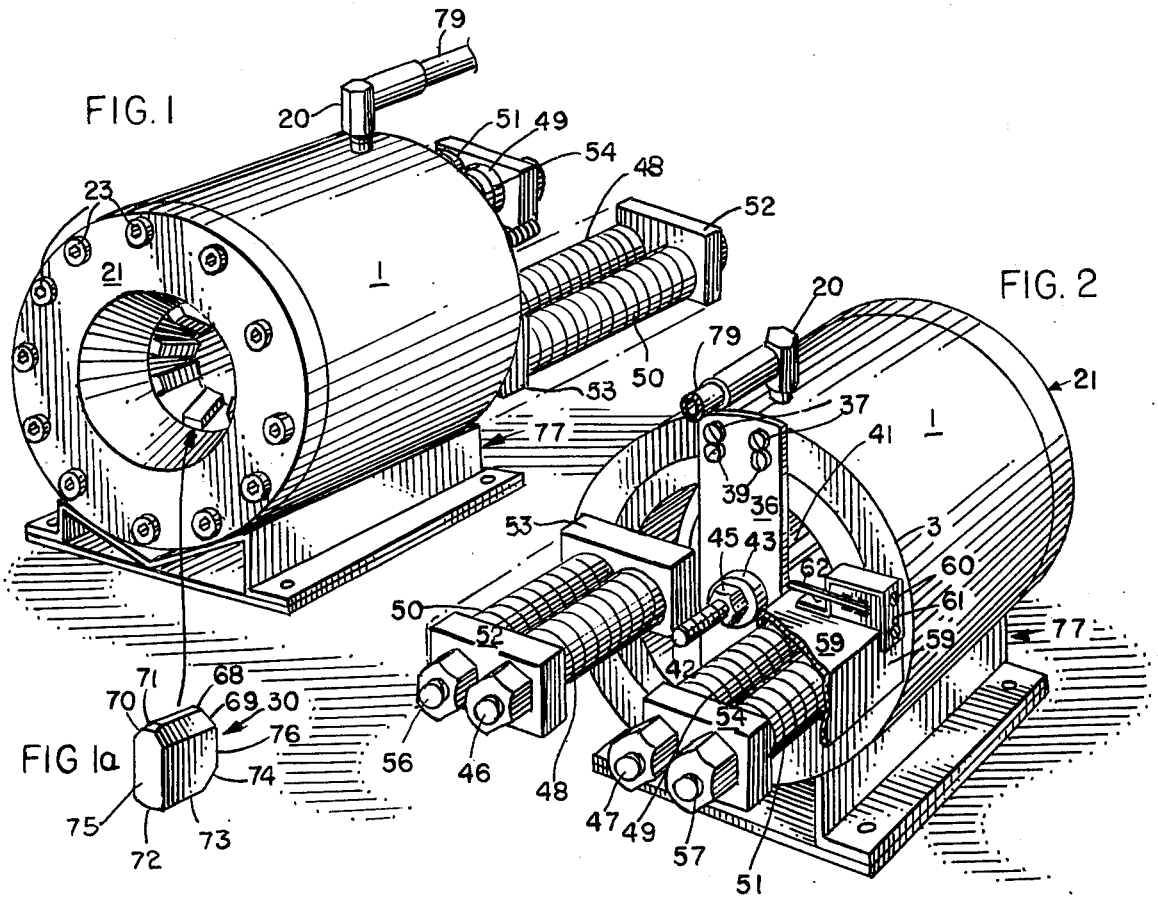
Figure 3:
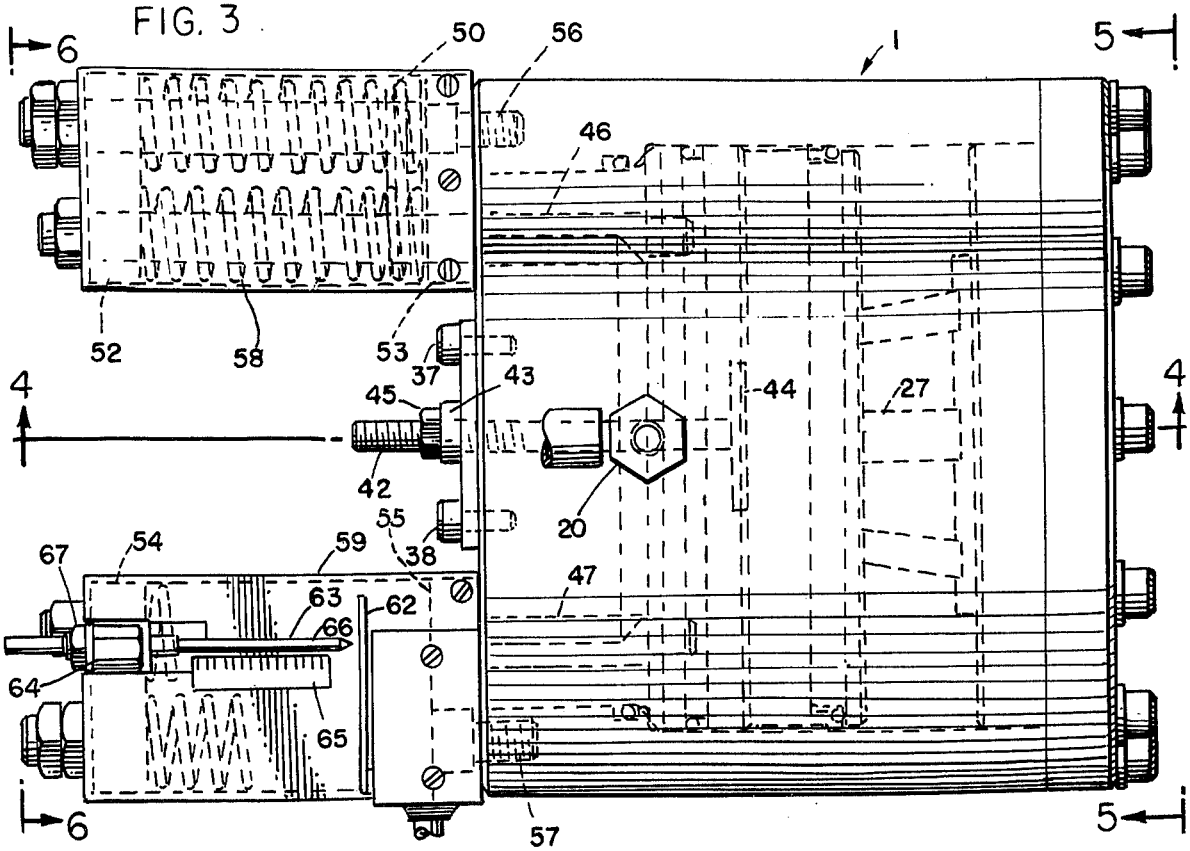
FIG. 3 is a top plan view of the apparatus shown in FIG. 2.
Figure 4:
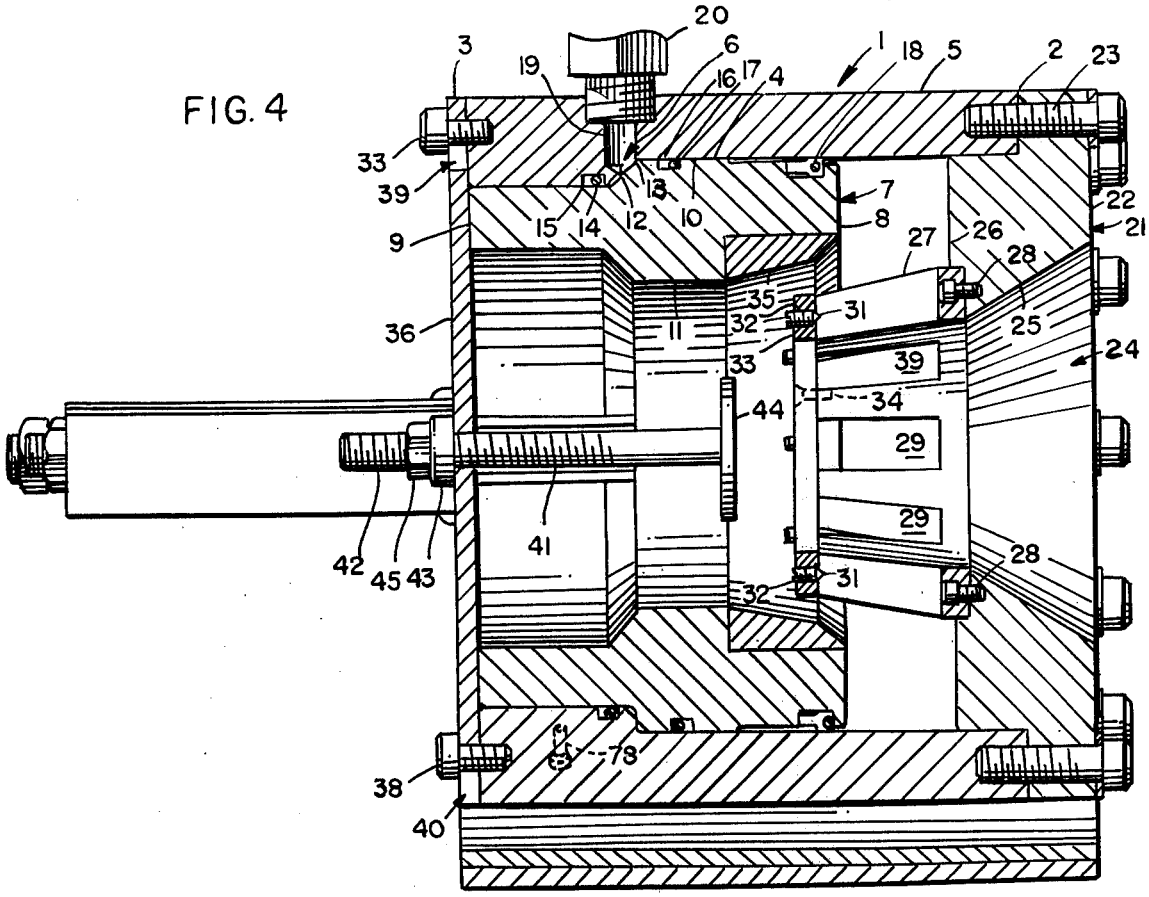
FIG. 4 is a cross sectional view taken along the line 4,4 of FIG. 3.

Referring to FIGS. 1 to 6 of the drawings, where like numerals indicate like parts, and particularly FIG. 4, the crimping apparatus illustrated comprises a cylindrical housing 1 having a forward end 2, a rear end 3, an inner wall 4, and an outer wall 5, said inner wall being offset inwardly at an intermediate point 6 between said forward and rear ends.

A tubular piston 7 having a forward end 8, a rear end 9, an outer wall 10 and an inner wall 11 with an offset portion 12 is disposed within said housing so that the offset portion 12 is complemental to the offset portion 6 of the housing and the piston is movable longitudinally from the retracted position shown in FIG. 4 in which said offset portions 6 and 12 are adjacent one another to forward position in which said offset portion 12 is moved forwardly with respect to the offset portion 6.

The piston 7 has a chamfer at 13 and is sealed with respect to the inner wall of the cylindrical housing 1 by an O-ring 14, a back-up ring 15, an O-ring 16, a back-up ring 17, and a scraper ring 18. Fluid under pressure is introduced into conduit 19 through fitting 20.

The front of the apparatus 21 has a face plate 22 which is fastened to the front end of cylindrical housing 1 by means of threaded screws 23. The face plate 22 has a central passageway 24 with converging walls 25.

Figure 9:
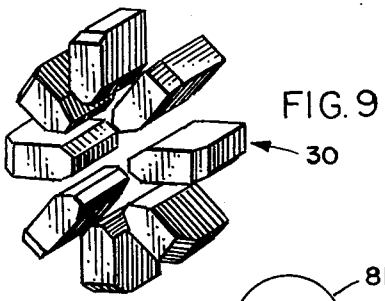
FIG. 9 is a perspective view of the crimping dies employed in the apparatus.

The rear end 26 of face plate 22 is secured to die holder 27 by means of threaded screw 28. Die holder 27 contains eight radial passageways 29 adapted to accommodate the crimping dies 30 shown in FIG. 9. In the embodiment illustrated there are eight crimping dies arranged with three dies above the horizontal center line and five dies at or below the horizontal center line. These dies are slidable radially in the passageways 29 in die holder 27. Each of the dies is held in place by means of a ball plunger 31 which is resiliently pressed against the end of the die by a spring in tubular screw 32. When the piston 7 is in the retracted position shown in FIG. 4 the dies can be moved in and out radially toward the central passageway between the dies by manual or hand pressure or by pressing a fitting carried on a tubular hose in the central passageway between the dies so that prior to the forward movement of piston 7 the position of the dies is controlled by gravity.

The rear end of the die holder 27 comprises a die retainer plate 33 which is secured to the die holder by means of screws 34. The forward end 8 of tubular piston 7 has a cam surface 35 on the inner wall 11 which causes the crimping dies 30 to be cammed radially as piston 7 moves forward longitudinally.

The central passageway 24 extends between the crimping dies 30 and between the inner wall 11 of tubular piston 7. According to one embodiment of the invention a stop plate 36 is secured by means of screws 37 and 38 to the rear end 3 of cylindrical housing 1 and extends in a plane which intersects the path or longitudinal axis of the elongated member and fitting when the latter are positioned between the crimping dies. The stop plate 36 is detachable because of the keyhole slot 39 and the open ended slots 40. Hence the apparatus can be operated without the stop plate 36 simply by detaching it by moving it upwardly until it is disengaged from the slots 39 and 40. However, in normal operation it is desirable to have the stop plate 36 attached to the rear end of the cylindrical housing as shown in the drawings so that the threaded member 41 can be grasped by the end 42 and rotated in the internally threaded member 43 so as to move the positioning member 44 longitudinally to a predetermined position in contact with the end of the fitting which is to be crimped to a hose or elongated member. Once the predetermined position has been determined, the lock nut 45 is tightened against threaded member 43 in order to lock the positioning screw 41 in place. Thereafter any number of fittings and elongated members to which they are applied of the same size and shape can be crimped without changing the position of positioning member 44.

It is desirable that the stop plate 36 be relatively rigid but sufficiently strong and resilient to yield under the pressure produced by the crimping dies which tends to force the elongated member and fitting in the direction of the stop plate during the crimping action of the dies.

Referring to FIGS. 2 and 4, rods 46 and 47 are fixed to the rear end of tubular piston 7 on opposite sides thereof and are fastened to compression springs 48 and 49 that when piston 7 moves forward longitudinally the springs 48 and 49 are compressed, and when the pressure causing the forward movement of piston 7 is released the compressive force built up by these springs will retract piston 7 to its initial starting position. Inasmuch as a substantial amount of force is required to retract piston 7 auxiliary springs 50 and 51 are provided which are connected by means of spring plates 52, 53, and 54, 55 so that springs 48, 50 and 49, 51 move in unison. The springs 50 and 51 are mounted on rods 56 and 57 which are threadedly secured to the rear end of cylindrical housing 1.

Each pair of springs 48, 50 and 49, 51 is enclosed by cover plates 58 and 59, respectively.

As a further feature of the invention, means are provided to automatically stop the longitudinal movement of the tubular piston 7 at a predetermined position thereby controlling the pressure which is applied by the crimping dies and preventing the application of an excessive amount of pressure which might tend to damage the fitting. Ordinarily, the forward movement of the tubular piston 7 will be stopped within an eighth of an inch of the inner wall 26 of the face plate 21. In order to control this forward movement of tubular piston 7, a microswitch generally indicated at 60 is enclosed in a housing 61 which is fastened either to the cover 59 by means of a screw shown in FIG. 2, or to the rear end 3 of the cylindrical housing 1. The microswitch is actuated by a contact blade 62 which in turn is actuated by a rod 63 which is threadedly mounted in a threaded member 64. On the top of cover 59 a scale 65 is mounted adjacent rod member 63 and an indicator score line 66 which is on rod member 63 is positioned opposite said scale so that by rotating member 63 it can be moved longitudinally toward and away from switch actuating blade 62 and can be locked into position by a lock nut 67. The mounting member 64 is fastened to spring plate 54 so that rod member 63 will move longitudinally in a forward direction simultaneously with the forward movement of tubular piston 7. When the predetermined pre-set position is reached, the end of member 63 will press against contact member 62 and open an electrical circuit controlling the fluid pressure to piston 7, thereby stopping the forward movement of piston 7. At this point the crimping operation has been completed so that the pressure on the piston 7 can be released and the springs 48, 49, 50 and 51 will retract piston 7 to its initial position.

Each of the crimping dies 30 has an arcuate inner surface 68, a pair of tapered surfaces 69 and 70, a chamfer 71, a rounded outer surface 72 which is tapered at 73 and has a chamfer at 74. The front and back walls 75 and 76 are substantially vertical. Thus, as the cam surface 35 moves forwardly against crimping dies 30 it first strikes the chamfer 74 and then the area 73 causing all of the dies to move radially so that the inner arcuate surfaces 68 press the fitting against the elongated member to which it is being applied.

Figure 5:
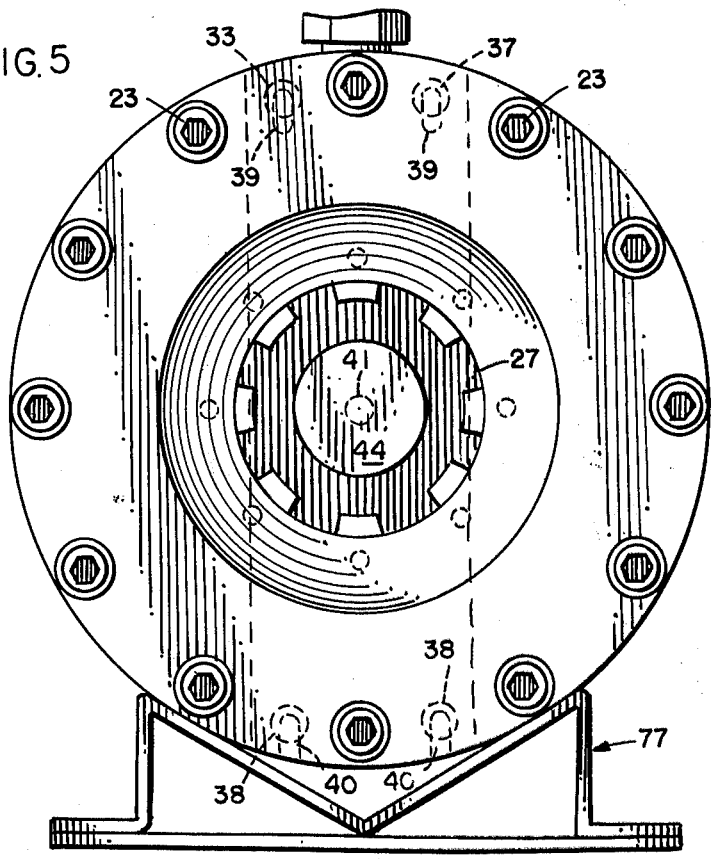
FIG. 5 is a front view taken along the lone 5,5 of FIG. 3.

The crimping apparatus is preferably mounted on a mounting 77 as shown in FIGS. 4 and 5 which is secured by means of screws 78 to the underside of the housing 1. This provides a crimping apparatus in a horizontal position. However, the apparatus could be mounted vertically.

Figure 7:
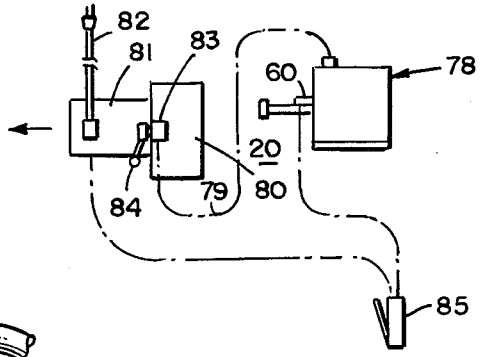
FIG. 7 is a diagrammatic view illustrating the crimping apparatus and the manner in which it is operated.
Figure 8:
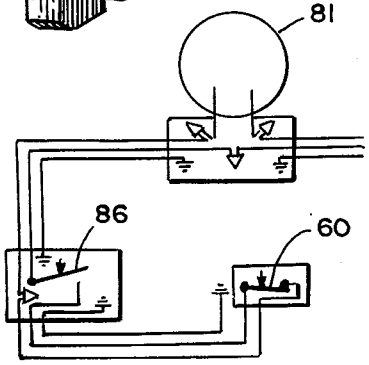
FIG. 8 illustrates an electrical circuit employed in the operation of the apparatus.
Figure 6:
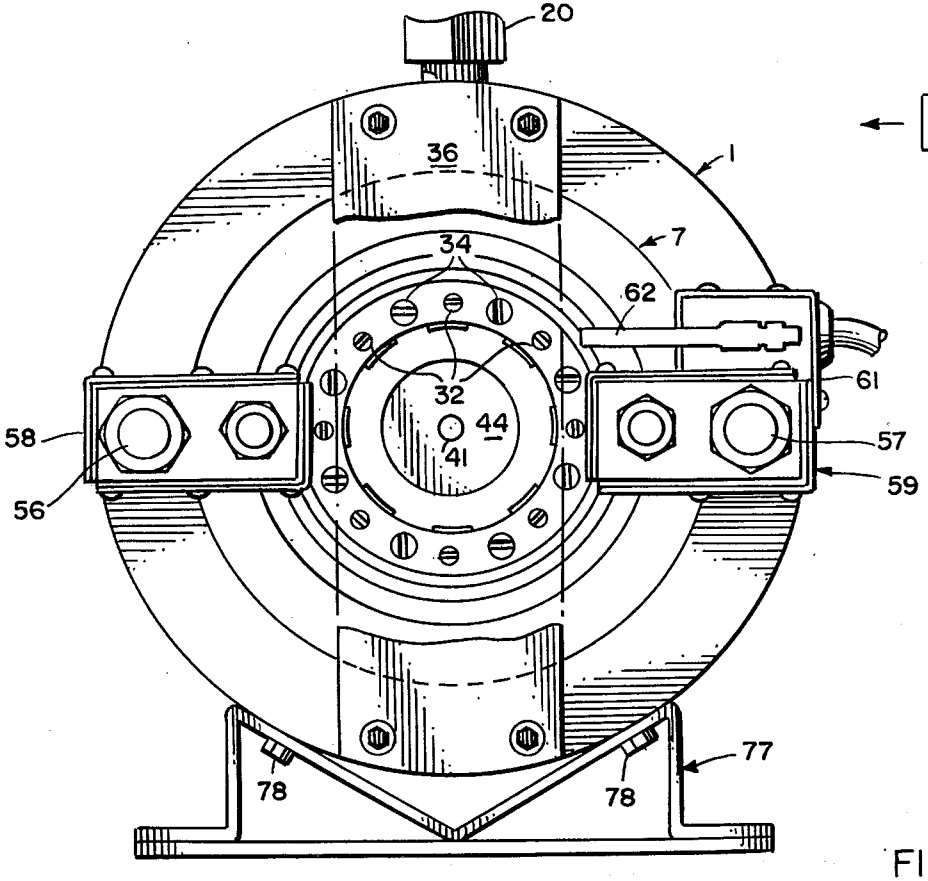
FIG. 6 is a rear view taken along the line 6,6 of FIG. 3.

Referring to FIG. 7 the crimping apparatus 78 is connected by fitting 20 through hydraulic hose 79 to hydraulic pump 80 which is operated by an electric motor generally indicated at 81 connected to a source of electrical current by electrical conductor 82. The flow of hydraulic fluid through conduit 79 is controlled by a valve 83 which is opened and closed by a lever 84. The foot pedal 85 is connected to a switch 86 as shown in FIG. 8 so that closing switch 86 will energize motor 81 and operate hydraulic pump 80. Limit switch 60 is normally closed.

When the crimping operation is begun, the fitting is placed on the hose or other elongated member and inserted usually through the front of the crimping apparatus between the crimping dies and the threaded member 41 is adjusted so that the stop member 44 is in contact with the fitting. The valve 83 to the hydraulic pump 80 is then opened by moving lever 84 and the motor circuit is closed by stepping on foot switch 85. This causes the hydraulic fluid to flow through conduit 79 and through fitting 20 and conduit 19 and to impinge against the chamfer 13 on the outer wall 4 of tubular piston 7, thereby causing said piston to move forward. As the piston moves forward the cam surface 35 strikes the outer surfaces of the crimping dies 30 causing them to move radially inwardly. At the same time the rod 63 is moving forward to the present position on scale 65 until it actuates contact blade 62 which then opens limit switch 60 and de-energizes the motor 81, thereby stopping pump 80. The crimping operation is then complete. The valve 83 is moved in the opposite direction to permit flow of the fluid through hydraulic hose 79 back to hydraulic pump 80. This permits the springs 48, 49, 50 and 51 to retract tubular piston 7 to its initial or starting position.

The crimping machine of the present invention can handle a full complement of sizes of hoses and fittings. The foot switch operation provides "hands free" operation of the machine. The structure of the crimping machine in combination with the valving and electrical circuitry enables the operator to accurately position work pieces in the machine. The die sets are relatively easy to change. Insofar as the operation of the pump is concerned, modifications can be made, for example, by equipping the pump with internal solenoid valves so that the motor remains on during the crimping operation.

It is thought that the invention and its numerous attendant advantages will be fully understood from the foregoing description, and it is obvious that numerous changes may be made in the form, construction and arrangement of the several parts without departing from the spirit or scope of the invention, or sacrificing any of its attendent advantages, the form herein disclosed being a preferred embodiment for the purpose of illustrating the invention.

We claim:

1. Apparatus for crimping a fitting onto an elongated member comprising:

a. a cylindrical housing having forward and rear ends and inner and outer walls, said inner wall being offset inwardly at an intermediate point between said forward and rear ends, b. a tubular piston in said cylindrical housing having forward and rear ends and inner and outer walls, said outer wall being offset outwardly complementally to the offset inner wall of said cylindrical housing and said piston being movable longitudinally in said housing from a retracted position in which said offset areas of (a) and (b) are adjacent one another to a forward position in which said offset area of (b) is moved forwardly with respect to the offset area of (a), c. a plurality of crimping dies moving radially together and apart, said tubular piston having means associated therewith to move said dies radially together when the piston moves forward longitudinally, and said piston providing a central passageway to receive said elongated member and a fitting, d. means for introducing and withdrawing a fluid under pressure through the outer wall of said cylindrical housing and the inner wall of said cylindrical housing in the area where said inner wall is offset inwardly so that said fluid will impinge on the offset portion of said outer wall of said piston and cause said piston to move forward longitudinally, e. means for causing said piston to retract and return to its initial retracted position after it has moved forwardly and actuated said dies, and f. mounting means for said cylindrical housing, said apparatus having a detatchable stop plate connected to the rear end of said cylindrical housing extending in a plane which intersects the path of said elongated member and fitting when the latter are positioned between the crimping dies.

2. Apparatus as claimed in claim 1 in which the retracted position of said tubular piston in said cylindrical housing does not extend beyond the rear end of said cylindrical housing.

3. Apparatus as claimed in claim 1 in which the central passageway in said piston is large enough to receive non-linear fittings.

4. Apparatus as claimed in claim 1 in which the forward end of said cylindrical housing is secured to an annuluar face member having a central passageway of sufficient size to receive said elongated member and a fitting, said passageway leading to the passageway between said crimping dies.

5. Apparatus as claimed in claim 1 in which the forward end of said cylindrical housing is secured to an annular face member and a die holder for holding said crimping dies is secured to said face member inwardly from the forward end of said cylindrical housing.

6. Apparatus as claimed in claim 1 in which said means associated with said piston to cause said dies to move radially comprises a camming surface at the forward portion of the inner wall of said piston for engaging said dies to move them radially together when the piston moves forward longitudinally.

7. Apparatus as claimed in claim 1 in which said piston has a chamfer at the offset portion of its outer wall.

8. Apparatus as claimed in claim 1 in which said stop plate contains a member which is adjustable longitudinally in the path of said elongated member and fitting when the latter are positioned between the crimping dies.

9. Apparatus as claimed in claim 1 in which said stop plate contains a threaded portion and a threaded member having its threads engaging said threaded portion and movable longitudinally in the path of said elongated member and fitting when the latter are inserted between the crimping dies, the inner end of said threaded member adjacent said elongated member and fitting containing a stop member and said threaded member also containing a lock nut adjacent said stop plate to lock said threaded member in a predetermined position with said stop member contacting said elongated member and fitting.

10. Apparatus as claimed in claim 1 in which said stop plate is relatively rigid but sufficiently strong and resilient to yield under the pressure produced by the crimping dies which tends to force the elongated member and fitting in the direction of the stop plate during the crimping action of the dies.

11. Apparatus for crimping a fitting onto an elongated member comprising:

a. a cylindrical housing having forward and rear ends and inner and outer walls, b. a tubular piston in said cylindrical housing having forward and rear ends and inner and outer walls, said piston being movable longitudinally in said housing from a retracted position to a forward position c. a plurality of crimping dies moving radially together and apart, said tubular piston having means associated therewith to move said dies radially together when the piston moves forwarded longitudinally, and said piston providing a central passageway to receive said elongated member and a fitting, d. means for causing said piston to move forward longitudinally to actuate said dies and cause them to move radially together, e. spring means connected to the rear of said piston for causing said piston to retract and return to its initial retracted position after it has moved forwardly and actuated said dies, and f. mounting means for said cylindrical housing, said apparatus comprising a pair of rods on opposite sides of the rear of said cylindrical housing and said tubular piston, each rod containing a compression spring slidably mounted thereon, one rod in each pair being fixedly secured to the rear end of said housing and another rod in each pair being secured to the rear end of said tubular piston and movable therewith, the springs on each pair of rods being connected so that compression of one spring produces compression of the other spring, so that the forward movement of said piston compresses said springs and said piston is retracted by the pressure from said springs when the fluid pressure on said piston is released.

12. Apparatus for crimping a fitting onto an elongated member comprising:

a. a cylindrical housing having forward and rear ends and inner and outer walls, b. a tubular piston in said cylindrical housing having forward and rear ends and inner and outer walls, said piston being movable longitudinally in said housing from the retracted position to a forward position, c. a plurality of crimping dies moving radially together and apart, said tubular piston having means associated therewith to move said dies radially together when the piston moves forward longitudinally, and said piston providing a central passageway to receive said elongated member and a fitting, d. means for causing said piston to move forward longitudinally to actuate said dies and to cause them to move radially together, e. means for causing said piston to retract and return to its initial retracted position after it has moved forwardly and actuated said dies, f. mounting means for said cylindrical housing, and g. a stop plate connected to the rear of said cylindrical housing extending in a plane which intersects the path of said elongated member and fitting when the latter are positioned between the crimping dies, said stop plate containing a threaded member which is adjustable longitudinally in the path of said elongated member and fitting when the latter are positioned between the crimping dies.

13. Apparatus as claimed in claim 12 in which said stop plate contains a threaded portion and a threaded member having its threads engaging said threaded portion and movable longitudinally in the path of said elongated member and fitting when the latter are inserted between the crimping dies, the inner end of said threaded member adjacent said elongated member and fitting containing a stop member and said threaded member also containing a lock nut adjacent said stop plate to lock said threaded member in a predetermined position with said stop member contacting said elongated member and fitting.

14. Apparatus for crimping a fitting onto an elongated member comprising:

a. a cylindrical housing having forward and rear ends and inner and outer walls, said inner wall being offset inwardly at an intermediate point between said forward and rear ends, b. a tubular piston in said cylindrical housing having forward and rear ends and inner and outer walls, said outer wall being offset outwardly complementally to the offset inner wall of said cylindrical housing and said piston being movable longitudinally in said housing from a retracted position in which said offset areas of (a) and (b) are adjacent one another to a forward position in which said offset area of (b) is moved forwardly with respect to the offset area of (a), c. a plurality of crimping dies moving radially together and apart, said tubular piston having means associated therewith to move said dies radially together when the piston moves forward longitudinally, and said piston providing a central passageway to receive said elongated member and a fitting, d. means for introducing and withdrawing a fluid under pressure through the outer wall of said cylindrical housing and the inner wall of said cylindrical housing in the area where said inner wall is offset inwardly so that said fluid will impinge on the offset portion of said outer wall of said piston and cause said piston to move forward longitudinally, e. means for causing said piston to retract and return to its initial retracted position after it has moved forwardly and actuated said dies, and f. mounting means for said cylindrical housing, said means of (e) for causing said piston to retract and return to its initial retracted position after it hav moved forwardly and actuated said dies comprising spring means connected to the rear of said piston which is compressed during the forward movement of said piston.

15. Apparatus as claimed in claim 14 in which said means for causing said piston to retract comprises a rod extending rearwardly and longitudinally from the rear end of said piston, said rod containing a compression spring.

16. Apparatus as claimed in claim 14 comprising a pair of rods on opposite sides of the rear of said cylindrical housing and said tubular piston, each rod containing a compression spring slidably mounted thereon, one rod in each pair being fixedly secured to the rear end of said housing and another rod in each pair being secured to the rear end of said tubular piston and movable therewith, the springs on each pair of rods being connected so that compression of one spring produces compression of the other spring, so that the forward movement of said piston compresses said springs and said piston is retracted by the pressure from said springs when the fluid pressure on said piston is released.

17. Apparatus for crimping a fitting onto an elongated member comprising:

a. a cylindrical housing having forward and rear ends and inner and outer walls, b. a tubular piston in said cylindrical housing having forward and rear ends and inner and outer walls, said piston being movable longitudinally in said housing from a retracted position to a forward position, c. a plurality of crimping dies moving radially together and apart, said tubular piston having means associated therewith to move said dies radially together when the piston moves forward longitudinally, and said piston providing a central passageway to receive said elongated member and a fitting, d. means for causing said piston to move forward longitudinally to actuate said dies and to cause them to move radially together, e. means for causing said piston to retract and return to its initial retracted position after it has moved forwardly and actuated said dies, f. mounting means for said cylindrical housing, and g. a stop plate connected to the rear of said cylindrical housing extending in a plane which intersects the path of said elongated member and fitting when the latter are positioned between the crimping dies, said stop plate being relatively rigid but sufficiently strong and resilient to yield under the pressure produced by the crimping dies which tends to force the elongated member and fitting in the direction of the stop plate during the crimping action of the dies.

* * * * *

UNITED STATES PATENT AND TRADEMARK OFFICE

CERTIFICATE OF CORRECTION

PATENT NO. : 4,014,202

DATED : March 29, 1977

INVENTOR(S) : RICHARD VAN ALLEN AND RAYMOND M. WYLIE

It is certified that error appears in the above-identified patent and that said Letters Patent are hereby corrected as shown below:

In the "References Cited"; the date of issuance of Baker, U.S. 3,154,978 should read --11/1964--.

Column 1, line 39, "objects" should read --object--.

Column 1, line 58, "lone" should read --line--.

Column 8, line 33, "hav" should read --has--.

Signed and Sealed this

*twelfth* Day of *July 1977*

[SEAL]

*Attest:*

RUTH C. MASON
*Attesting Officer*

C. MARSHALL DANN
*Commissioner of Patents and Trademarks*